US007549779B2

(12) United States Patent
Genenbacher

(10) Patent No.: US 7,549,779 B2
(45) Date of Patent: Jun. 23, 2009

(54) MAGNETIC LIGHT FIXTURE

(76) Inventor: Shawn Michael Genenbacher, P.O. Box 65467, Lubbock, TX (US) 79464

( * ) Notice: Subject to any disclaimer, the term of this patent is extended or adjusted under 35 U.S.C. 154(b) by 0 days.

(21) Appl. No.: 11/676,146

(22) Filed: Feb. 16, 2007

(65) Prior Publication Data

US 2008/0198610 A1 Aug. 21, 2008

(51) Int. Cl.
*F21V 21/08* (2006.01)

(52) U.S. Cl. ..... 362/398; 362/249; 362/808

(58) Field of Classification Search ..... 362/249, 362/252, 398, 806, 808
See application file for complete search history.

(56) References Cited

U.S. PATENT DOCUMENTS 2,474,942 A * 7/1949 Hawkins ..... 439/40
3,038,139 A * 6/1962 Bonanno ..... 439/40
5,388,802 A 2/1995 Dougan
5,788,362 A * 8/1998 Chou ..... 362/249
5,873,651 A * 2/1999 Hofer et al. ..... 362/396
2006/0138293 A1 6/2006 Clement

* cited by examiner

*Primary Examiner*—John A Ward
(74) *Attorney, Agent, or Firm*—Carstens & Cahoon LLP; Vincent J. Allen

(57) ABSTRACT

The present invention provides a light fixture assembly. The assembly includes a light bulb socket with an opening at one end for accommodating C7/C9 light bulbs and at least one opening at the second end. The socket includes a conductor that places a light bulb into electrical contact with electrical wires inserted through the side of the socket. The assembly also includes a base attached to the second end of the socket. The base includes a wire clamp that fits through the opening in the second end of the socket and holds the electrical wires in contact with the conductor. Retaining clips on the base apply a retaining force against the socket to hold the base in place. A neodymium disc magnet is embedded in the base, thereby allowing the assembly to be mounted magnetically to metal surfaces.

15 Claims, 3 Drawing Sheets

MAGNETIC LIGHT FIXTURE

TECHNICAL FIELD

The present invention relates generally to decorative lights. More specifically the invention relates to decorative lights that are mounted to metal surfaces by means of imbedded magnets.

BACKGROUND OF THE INVENTION

Decorative lights typically do not come provided with means for mounting them to display surfaces such as housing sides or poles. The traditional means of attaching such decorative lights is by stapling them to the sides of houses or trees or wrapping them around poles and trees. However, stapling has several potential drawbacks including damage to the mounting surface (which increases with repeated mounting and dismounting of the lights), potential damage to the electrical cord from the staples, as well as potential injury to the user during the stapling process. Stapling also turns the light mounting process into a two-handed operation, requiring one hand to hold the lights and wires in place and the other to work the stapler. Stapling is also unsatisfactory in cases where houses have metal siding.

In the case of metal poles or similar objects, simply wrapping the light wires may not properly secure them in position and prevent them from falling. In such situations, securing methods such as tape might not provide sufficient long term adherence, especially outdoors, and might be visually unappealing.

Several methods have been proposed in the prior art for overcoming the above disadvantages. One solution is provided by Dougan et al. (U.S. Pat. No. 5,388,802) This approach provides a clip that is secured to the electric cord that connects a string of lights. The main body of the clip is a flexible, V-shaped member which is compressed and wedged between the fascia and soffit of a house. When installed, the lights protrude perpendicularly below the fascia and are clearly visible, while the wedge shaped members are substantially hidden from view by the fascia. While the Dougan invention offers substantial improvements over simply stapling the lights in place, it is limited to mounting lights on the eaves on a house. Furthermore, Dougan requires a separate set of clips/wedges to be purchased and then added to the string of lights before mounting them. While the insertion and removal of the wedges from the fascia and soffit may seem simple in theory, it is likely the user will encounter some difficulties in this operation.

Another proposed solution to mounting decorative lights is that of Clement (U.S. Patent Application Ser. No. 2006/0138293). Similar to Dougan, Clement provides a member that is clipped to the electrical cord of a string of decorative lights. Unlike Dougan, the member taught in Clement uses a magnet to secure it to metal surfaces. This approach provides more flexibility in mounting options as well as greater ease of mounting than the Dougan invention. However, Clement still requires the user to purchase a separate set of members and then clip them onto the electrical cord of the light string before mounting the lights, requiring additional time and effort.

Therefore, it would be desirable to have a method for temporarily mounting a string of decorative lights to a metal surface without the need for damaging the surface and without the need to install additional items to the light string.

SUMMARY OF THE INVENTION

The present invention provides a light fixture assembly. The assembly includes a light bulb socket with an opening at one end for accommodating C7/C9 light bulbs and at least one opening at the second end. The socket includes a conductor that places a light bulb into electrical contact with electrical wires inserted through the side of the socket. The assembly also includes a base attached to the second end of the socket. The base includes a wire clamp that fits through the opening in the second end of the socket and holds the electrical wires in contact with the conductor. Retaining clips on the base apply a retaining force against the socket to hold the base in place. The retaining clips may be molded from the sides of the wire clamp or independent from the clamp and inserted through separate holes in the end of the socket. An N40 neodymium disc magnet is embedded in the base, thereby allowing the assembly to be mounted magnetically to metal surfaces. In the preferred embodiment, the neodymium magnet is ½ inch diameter and ⅛ inch thick and mounted flush with the surface of the base, with a pull strength of 16 pounds. In an alternate embodiment, the light assembly may also include an external clip on the side of either the base or the socket.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

The present invention provides a magnetic base for decorative lights that are strung together by an electrical cord. The invention works with standard C7/C9 light bulbs.

Figure 1:
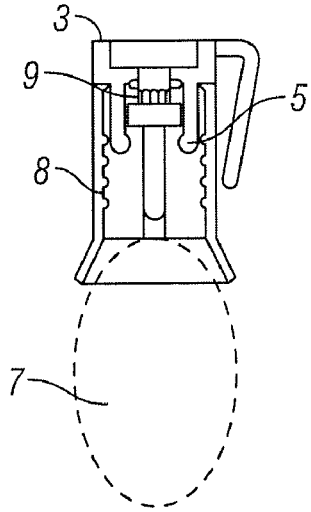
FIG. 1 is a cross section view of a light assembly in accordance with the preferred embodiment of the present invention.

FIG. 1 is a cross section view of a light assembly in accordance with the preferred embodiment of the present invention. The light assembly is comprised of three major components. The first is the light bulb 7, which is depicted is dashed outline. The second major component is the light bulb socket 8. The third component is the assembly base 3.

Figure 2:
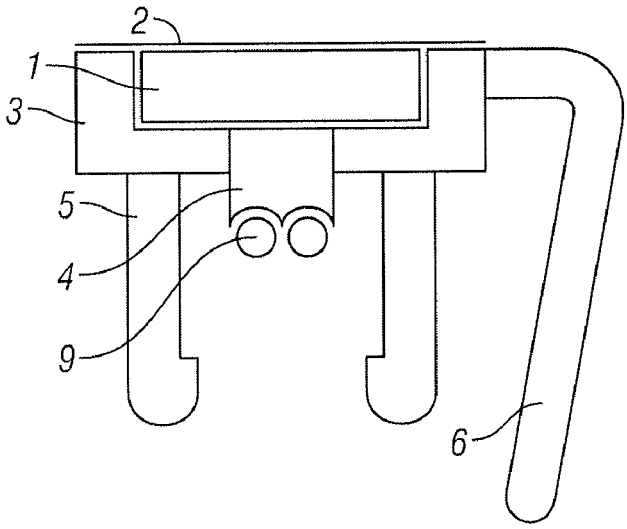
FIG. 2 is a detailed cross section view of the assembly base containing a magnet in accordance with the present invention.

FIG. 2 is a detailed cross section view of the assembly base containing a magnet in accordance with the present invention. The assembly base 3 is constructed of plastic or similar material and has an embedded neodymium magnet 1. In the preferred embodiment, the magnet 1 is a disc ½ inch diameter× ⅛ inch thick. Other shapes, sizes and thicknesses can be used, but the dimensions of the disc magnet in the preferred embodiment tend to be best suited for use with a C7/C9 light socket.

A neodymium magnet is made from a combination of neodymium, iron, and boron ($Nd_2Fe_{14}B$). Neodymium magnets have replaced the marginally weaker samarium-cobalt magnets in most applications, due mainly to lower cost. These magnets are very strong in comparison to their mass and are graded in strength from N24 to the strongest N54. The number after the N represents the magnetic energy product, in megagauss-oersteds (MGOe). In the preferred embodiment, the neodymium magnet is N40 with a pull force of 16 pounds. Other strength magnets may be used, but ideally, the magnet pull force should be sufficient to hold the light assembly in place in normal outdoor conditions including wind.

As shown, the magnet 1 is embedded flush with the surface of the assembly base 3, allowing only the face of the magnet to be exposed. The exposed face of the magnet 1 is illustrated in the plan view of the base in FIG. 3. A plastic protection coating 2 is placed over the face of the magnet 3.

The base 3 also includes two retaining clips 5 for engaging the light socket 8 and holding the base in place. A molded wire clamp 4 in the base helps to hold the electrical wires 9 in contact with a copper conductor 10 in the socket 8 when the base 3 and socket 8 are assembled, as shown in FIG. 1.

Figure 4:
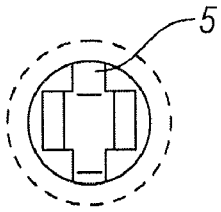
FIG. 4 is a bottom plan view of the assembly base showing the ends of retaining clip in accordance with the present invention.

FIG. 4 is a bottom plan view of the assembly base showing the ends of retaining clips 5 in accordance with the present invention.

The assembly base 3 may optionally include a side clip 6 which may be used to mount the light on a nonmetallic structure or may be used to mount additional decorations to the light.

Figure 5:
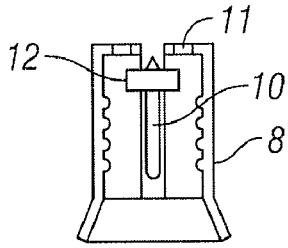
FIG. 5 is a detailed cross section view of the light socket in accordance with the present invention.

FIG. 5 is a detailed cross section view of the light socket in accordance with the present invention. Like the base 3, the socket 8 can be made from plastic or similar material. On the inside of the socket are two copper conductors 10 (only one which is illustrated in FIG. 5). The conductors 10 provide electrical connection between the wires 9 and the base of the light bulb (not pictured).

The socket 8 includes two slots 11, which accommodate the retaining clips 5 on the base 3. Inside the socket 8 is a retaining tab 12. The retaining tab 12 applies a retaining force against the ends of the retaining clips 5 when the assembly base 3 is mounted to the bottom of the socket 8. The retaining tab 12 also helps hold the electric wires 9 in place by acting as the opposing surface to the wire clamp 4 when the base and socket are assembled, as illustrated in FIG. 1.

Figure 3:
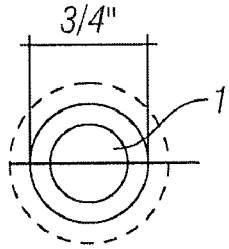
FIG. 3 is a plan view of the assembly base in accordance with the present invention.

In the preferred embodiment, the base 3 and socket 8 are both ¾ inch diameter (see FIG. 3).

Figure 6:
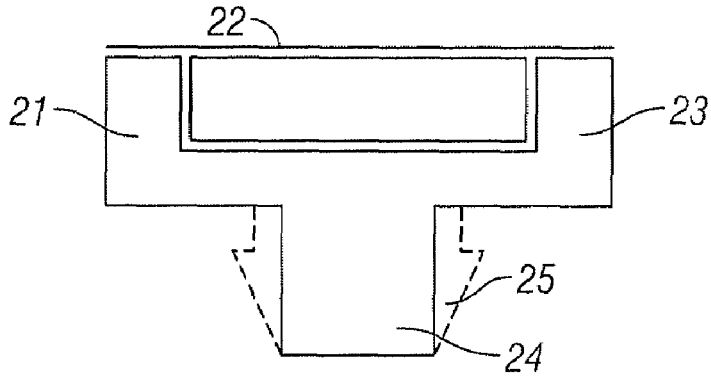
FIG. 6 is a detailed cross section view of the assembly base containing the magnet in accordance with an alternate embodiment of the present invention.

FIG. 6 is a detailed cross section view of the assembly base containing the magnet in accordance with an alternate embodiment of the present invention. The alternate embodiment of the assembly base 23 is very similar the assembly base 3 depicted in FIG. 2, the primary difference being the shape of the retaining clips 25 and the wire clamp 24. In this embodiment, the retaining clips 25 are molded from the sides of the wire clamp 24, as shown.

Unlike the assembly base 3 depicted in FIG. 2, the example depicted in FIG. 6 does not include a side clip 6. However, it should be noted that a side clip can be added to either version of the assembly base or alternately to the side of the light bulb socket, as shown in FIG. 9B.

Figure 7:
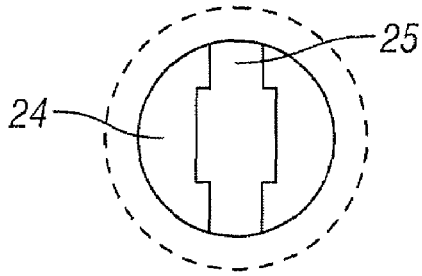
FIG. 7 is a bottom plan view of the alternate assembly base showing the bottom end of the wire clamp and side retaining clips in accordance with the alternate embodiment of thre present invention.

FIG. 7 is a bottom plan view of the alternate assembly base showing the bottom end of the wire clamp 24 and side retaining clips 25 in accordance with the alternate embodiment of the present invention.

Figure 8:
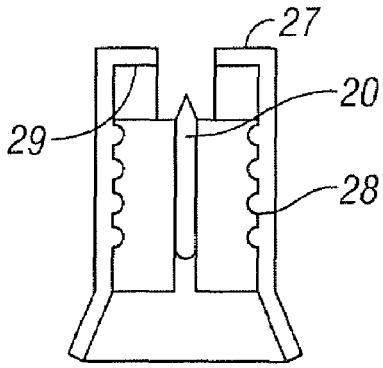
FIG. 8 is a detailed cross section view of the light socket in accordance with the alternate embodiment of the present invention.

FIG. 8 is a detailed cross section view of the light socket in accordance with the alternate embodiment of the present invention. In this embodiment, the socket 28 has a single, central slot 27 to accommodate the wire clamp 24. The retaining clips 25 engage the inside surface of the socket 29 when inserted through the slot 27.

Figure 9A:
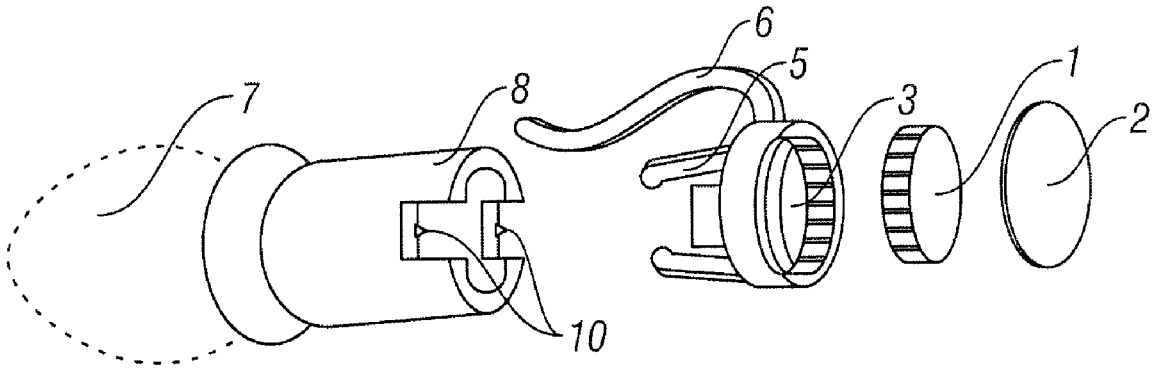
FIG. 9A is an exploded perspective view of the light assembly in Accordance with a preferred embodiment of the present invention.
Figure 9B:
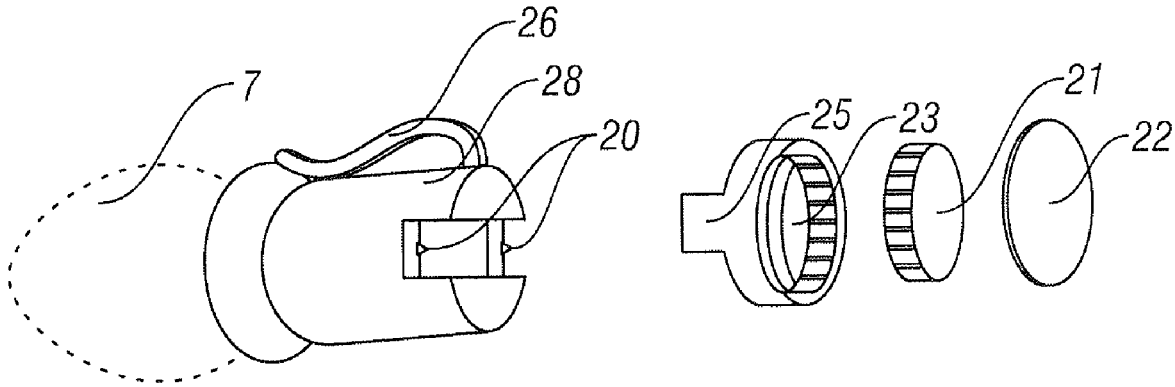
FIG. 9B is an exploded perspective view of the assembly in Accordance with an alternate embodiment of the present invention.

FIG. 9A is an exploded perspective view of the light assembly in accordance with a preferred embodiment of the present invention. This example comprises the componet embodiments depicted in FIGS. 2-5.

FIG. 9B is an exploded perspective view of the light assembly in accordance with an alternate embodiment of the present invention. This example comprises the component embodiments depicted in FIGS. 6-8. As mentioned above, FIG. 9B also shows an embodiment in which an optional side clip 26 is added to the socket 28 instead of the assembly base 23.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A light fixture assembly, comprising:

(a) a light bulb socket with an opening at the first end for accommodating a light bulb and at least one opening at the second end, wherein the socket includes a conductor that places a light bulb inserted into the first end in electrical contact with electrical wires inserted through the socket;

(b) a base attached to the second end of the light bulb socket; and (c) a neodymium magnet embedded in the base wherein said magnet has a pull strength of at least five pounds.

2. The light fixture assembly according to claim 1, wherein the socket accommodates C7 light bulbs.

3. The light fixture assembly according to claim 1, wherein the socket accommodates C9 light bulbs.

4. The light fixture assembly according to claim 1, wherein the retaining clips on the base are molded into the sides of the wire clamp and fit through the same hole in the second end of the socket as the wire clamp.

5. The light fixture assembly according to claim 1, wherein the retaining clips on the base are separate from the wire clamp and fit through separate holes in the second end of the socket.

6. The light fixture assembly according to claim 1, wherein the magnet is a neodymium magnet.

7. The light fixture assembly according to claim 6, wherein the magnet has a pull strength of 16 pounds.

8. The light fixture assembly according to claim 6, wherein the magnet has an N40 rating.

9. The light fixture assembly according to claim 1, wherein the magnet is a disc one half inch in diameter and one eighth inch thick.

10. The light fixture assembly according to claim 1, wherein the magnet is embedded flush with the surface of the base facing away from the light bulb.

11. The light fixture assembly according to claim 10, wherein the exposed face of the magnet is covered with a protective plastic coating.

12. The light fixture assembly according to claim 1, wherein the socket and base are three quarter inch diameter.

13. The light fixture assembly according to claim 1, further comprising an external clip on the side of the base.

14. The light fixture assembly according to claim 1, further comprising an external clip on the side of the socket.

15. The light fixture assembly of claim 1 wherein said base comprises:

(i) a wire clamp that fits through the opening in the second end of the socket and holds said electrical wires in contact with the conductor; and (ii) retaining clips that apply a retaining force against the socket to hold the base in place.

* * * * *